United States Patent [19]

Kelly et al.

[11] Patent Number: 5,036,789

[45] Date of Patent: Aug. 6, 1991

[54] JET SKI HULL AND METHOD OF MANUFACTURE

[76] Inventors: Roy T. Kelly, 114 Pontotoc La.; Shawn L. Kelly, 116 Pontotoc La., both of Shawnee, Okla. 74801

[21] Appl. No.: 489,332

[22] Filed: Mar. 1, 1990

[51] Int. Cl.[5] ..... B63B 5/24

[52] U.S. Cl. ..... 114/357; 114/270; 440/111

[58] Field of Search ..... 114/357, 270; 440/111; 156/245; 264/250

[56] References Cited

U.S. PATENT DOCUMENTS

| | | | |
|---|---|---|---|
| 3,634,898 | 1/1972 | Geiger | 114/357 |
| 3,775,214 | 11/1973 | Winters | 114/357 X |
| 3,790,977 | 2/1974 | Bombardier et al. | 114/357 |
| 4,021,874 | 5/1977 | Alter et al. | 114/357 |

FOREIGN PATENT DOCUMENTS

| | | | |
|---|---|---|---|
| 304822 | 3/1989 | European Pat. Off. | 114/270 |
| 122896 | 6/1987 | Japan | 114/270 |
| 28092 | 1/1990 | Japan | 114/270 |

*Primary Examiner*—Sherman Basinger
*Attorney, Agent, or Firm*—Head & Johnson

[57] ABSTRACT

A bottom hull for a jet type watercraft is comprised of fiber reinforced plastic (FRP) outer liner and a separately produced FRP inner liner having stiffeners within the inner liner and which are joined uniquely to form a sandwich construction which provides a lightweight hull with increased strength, increased speeds, and steady planing of the craft over the water.

10 Claims, 7 Drawing Sheets

JET SKI HULL AND METHOD OF MANUFACTURE

BACKGROUND

Sport boats or jet bike types of watercraft have become increasingly popular. Such craft are capable of planing, skipping, and jumping at speeds up to 40 miles per hour. Because of such speed and increasingly so where waves are generally present, the bottom hull of the craft receives a great deal of punishment due to the pounding against the water at such speeds.

By and large, major sport boat type of watercraft hulls are formed in a closed mold resin transfer molding (RTM) process or a vacuum molding process. In a RTM process, a two-piece mold consists of a female dye (cavity) and a male dye (core) used in the process. A composite mixture of resin, reinforcement, filler, and additives is placed between the two heated matched molds which are then closed under pressure to cure the composite into a solid reinforced plastic part. The reinforcement is usually placed on the lower mold, the mold halves are clamped together, and resin is pumped in under pressure. The most common reinforcement used is glass which is available as fibers, flakes, or spheres. Some carbon fibers and synthetic fibers, alone or combined with glass are also increasing in use. Both thermoplastic and thermoset resins are used in closed mold processing with polyesters being the most popular due to their unique blend of mechanical, electrical, and chemical-resistant properties and cost-effective performance. Thermoplastic resins used are nylon, polypropylene, and thermoplastic polyester. Hulls made by the RTM process are more costly and do not provide satisfactory means to rigidly fasten the propulsion system, hull fittings, hardware, etc. sufficient to take the pounding produced when in use and in many cases results in a flexible bottom hull which contributes to cyclical bouncing against the water.

Another popular form of manufacturing jet type watercraft hulls is by the open mold fiber reinforced plastic (FRP) process. There are three basic materials used in open mold processing: Resins (most frequently polyesters); glass fiber reinforcement in such configurations as woven roving, mat, and gun roving; and catalysts, most frequently methyl ethyl ketone peroxide (MEKP) or Benzoyl peroxide. In a well-known technique, the catalyst initiates a chemical reaction that transforms the liquid into a solid. The glass fiber reinforcement is encapsulated within the resin, giving structural strength. The three materials are applied to the mold simultaneously, either manually or by special spray-up equipment. A chemical chain reaction occurs forming a structural laminate. The laminate after a short carrying time is demolded, producing an exact duplicate of the mold. In a preliminary step, specially pigmented polyester resin (gel-coat) is applied to provide smoothness and color to the product. The gel-coat/catalyst mixture is built up to a thickness of 15 to 20 mil. Both the aesthetic (gel-coat) and structural (laminate) processes are performed in the open mold. Being from the same chemical family, the gel-coat crosslinks with the laminate. Watercraft hulls made by the FRP open mold process are several times less expensive and faster to make than hulls made by closed mold RTM process. However, the resulting hull has many disadvantages, primarily structural loss of strength, rigidity, and stiffness sufficient to withstand the pounding of the craft in use on the water.

As in a RTM process, to build up the laminate to reduce this defect adds tremendous weight to the craft, reducing its speed and portability. Another disadvantage of a craft formed by the FRP open mold process is that it produces a rather rough inner surface which is an undesirable characteristic in the interior of the hull since it allows the buildup of fuel residue and oil that cannot be easily cleaned if the surface were not gel-coat smooth.

In addition, flotation is usually required for the hull whether it be a RTM or FRP type. To do so, especially in a FRP type of hull, foam is usually formed in the sides of the craft. This requires a separate step of building a form (usually wood) to form cavities into which polyurethane foam is injected. However, once the foam has set, the release of the mold form is difficult due to the fact that without some form of release agent and in many instances with a release agent, the polyurethane foam tends to adhere to the form, leaving another rough, unsightly, and hard-to-clean interior surface. Polyurethane foams (PUR) generally are formed by mixing two primary ingredients during processing. For most commonly used PURs, the two ingredients are a polyisocyanate and a polyol. Typically, a closed cell PUR foam is formed by the release of a blowing agent which is largely retained as a closed cell.

SUMMARY OF THE INVENTION

It is a primary object of this invention to provide a jet type watercraft hull that is of greater strength, rigidity, stiffness, and lighter weight than known bottom hull designs of the prior art and yet is considerably faster, weight-for-weight and horsepower-for-horsepower than previous jet type hulls.

Another object of the invention is to provide a jet type watercraft hull design using FRP molding techniques in which the inner surface of the hull is of a smooth, readily cleanable texture.

A further object of the invention is to provide a jet type bottom hull design having an outer liner and an inner liner wherein the relationship between the two liners provides means for the placement and initial bonding of the two liners along the central portion of the hull and subsequent injection of polyurethane foam forming materials to fill flotation cavities in the sides of the hull and thus do away with extraneous molds or forms when using hulls heretofore made out of FRP in the open mold process. In other words, the inner hull becomes not only a structural member, but also a form creating cavities to receive PUR foam.

A yet further object of the invention is to provide a jet type watercraft bottom hull design having an outer liner and a spaced inner liner in which the latter can be made to close tolerances and which includes wood and/or other stiffeners and laminating materials at particular places for the exact placement and retention of through-the-hull fittings, mounting brackets, hardware, and/or the propulsion unit itself.

Another object of the invention is to provide a jet type watercraft in which the top portion of the jet type which supports the operator and riders is supported and/or laminated to the inner liner to support the gunwale and/or treads or other load-bearing portions of the watercraft.

Specifically, the invention is directed to a jet type watercraft bottom hull that includes the stem, sides, and transom upon which a top hull portion will be subsequently attached. The bottom hull portion comprises an outer liner and an inner liner which when assembled are spaced therefrom at certain areas of the hull. Both liners are separately premolded in open molds with gel-coated exposed surfaces upon which fiber reinforced plastic has been laid. The bottom surface of the outer liner is, in transverse cross-section, of a generally Vee-shape having a central planing portion joining with an upwardly stepped outward portion on each side thereof which intersects at the exterior chines with upwardly and outwardly directed sides which then terminates in an outward, then upward support lip.

The inner liner, which is separately premolded, has, in transverse cross-section when upright, a generally Vee-shaped inner central portion substantially corresponding to the central portion of the outer liner to an upward and outward short step in each side of the central portion. Substantially at the junction of the outer liner central portion and the upwardly and outwardly stepped portion, the inner liner will extend vertically upwardly, thence outward substantially horizontally forming a gunwale and treadway support for the top portion of the watercraft. The interior portion continues outwardly to downwardly extending lips which are adapted to be nested and supported inside the upward support lip of the outer liner. The inner liner, as it is preformed, includes a plurality of reinforcing, i.e. wood stringers or plates, which are premolded therewith. The wood stringers or plates are positioned at significant places so as to provide stiffness and also to provide means to attach fittings, propulsion equipment, and accessories thereto.

During the assembly of the bottom hull of this invention, a resin bonding agent is applied to those inner liner and outer liner surfaces which will come into contact with each other. Before the inner liner is placed into the outer liner, a polyurethane foam forming material is sprayed or brushed into the inside of the hull only in the central portion thereof, e.g. between the upward steps. The amount is such that the resulting foam is sufficient to fill the space between the inner liner and the outer liner. This foam material also crosslinks with the FRP to join the inner liner and the outer liner along the planing central portion of the hull. Subsequently, openings are made through the inner liner to communicate with the flotation space formed on the outer sides into which a polyurethane foam forming material is injected sufficient to fill the space therebetween and thus provide additional bonding of the two liners and rigidity and flotation to the hull. Of significance to the invention is the fact that in order to keep the inner liner and the outer liner from deforming during the assembly and foam forming processes, such steps occur while the outer liner and the inner liner are retained within the open molds or equivalent molds forming a sandwich therebetween wherein the weight of the top mold will act as a pressure means for retaining the outer and the inner liners together until the polyester resin and polyurethane foam materials have set up.

A yet further object of the invention is to provide a bottom hull design for a jet type watercraft that:

(1) Is lighter in weight than hulls of the prior art;
(2) Is structurally strengthened especially along the center portion of the hull;
(3) Has a smooth interior surface for cleaning; and
(4) Is so formed and balanced that the hull will not cyclically bounce and pound against the water but will immediately assume, in response to the propulsion, and substantially maintain, a planing position in the water, with the aft 28 inches or so actually touching the water.

DETAILED DESCRIPTION OF THE PREFERRED EMBODIMENTS

Before explaining the present invention in detail, it is to be understood that the invention is not limited in its application to the details of construction and arrangement of parts illustrated in the accompanying drawings. The invention is capable of other embodiments and of being practiced or carried out in a variety of ways. It is to be understood that the phraseology and terminology employed herein is for the purpose of description and not of limitation.

Figure 1:
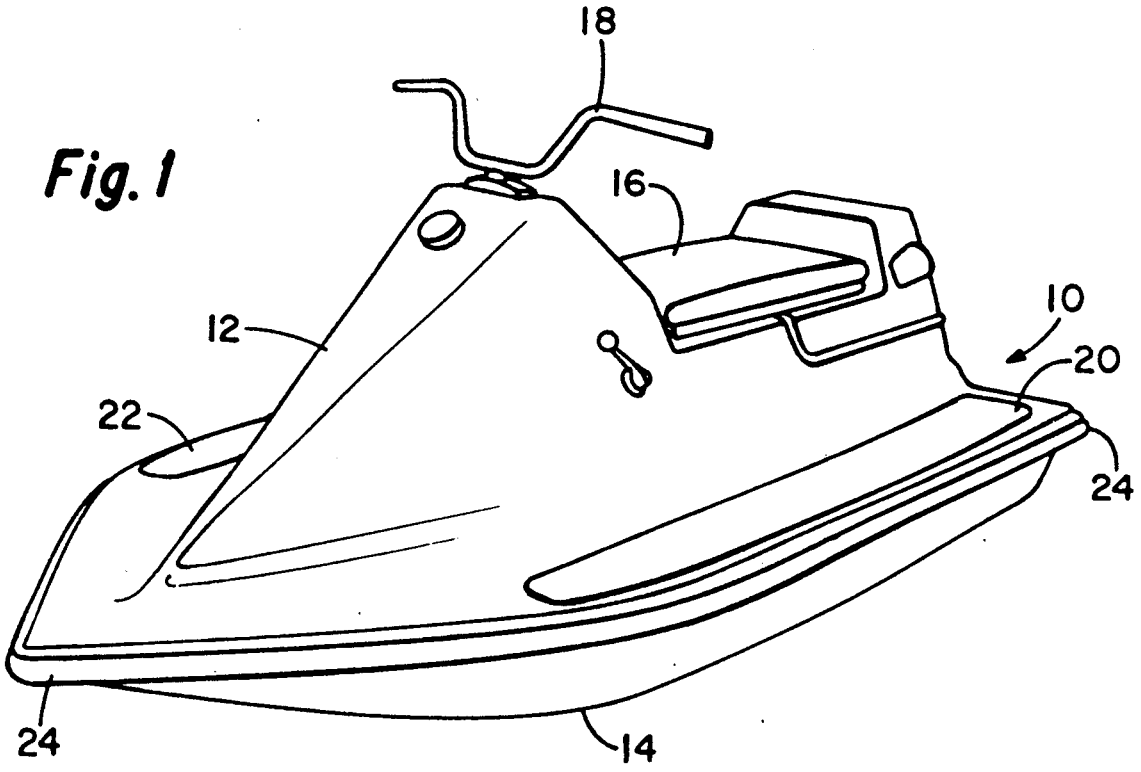
FIG. 1 is a perspective view of a typical jet type boat to which this invention is applicable.

FIG. 1 is a perspective view of a typical jet type watercraft generally designated by the numeral 10 and comprising a top hull 12 and a bottom hull 14. The top hull, which can be of a variety of design and shapes, generally includes a seat means 16, a steering handle means 18, and treadways 20 and 22 which, in this embodiment, also form a part of the gunnel. At the junction of the top hull 12 and the bottom hull 14 is a rub rail 24 which extends around the periphery of the watercraft. This invention, however, is directed to the bottom hull and the method of making same.

Figure 2:
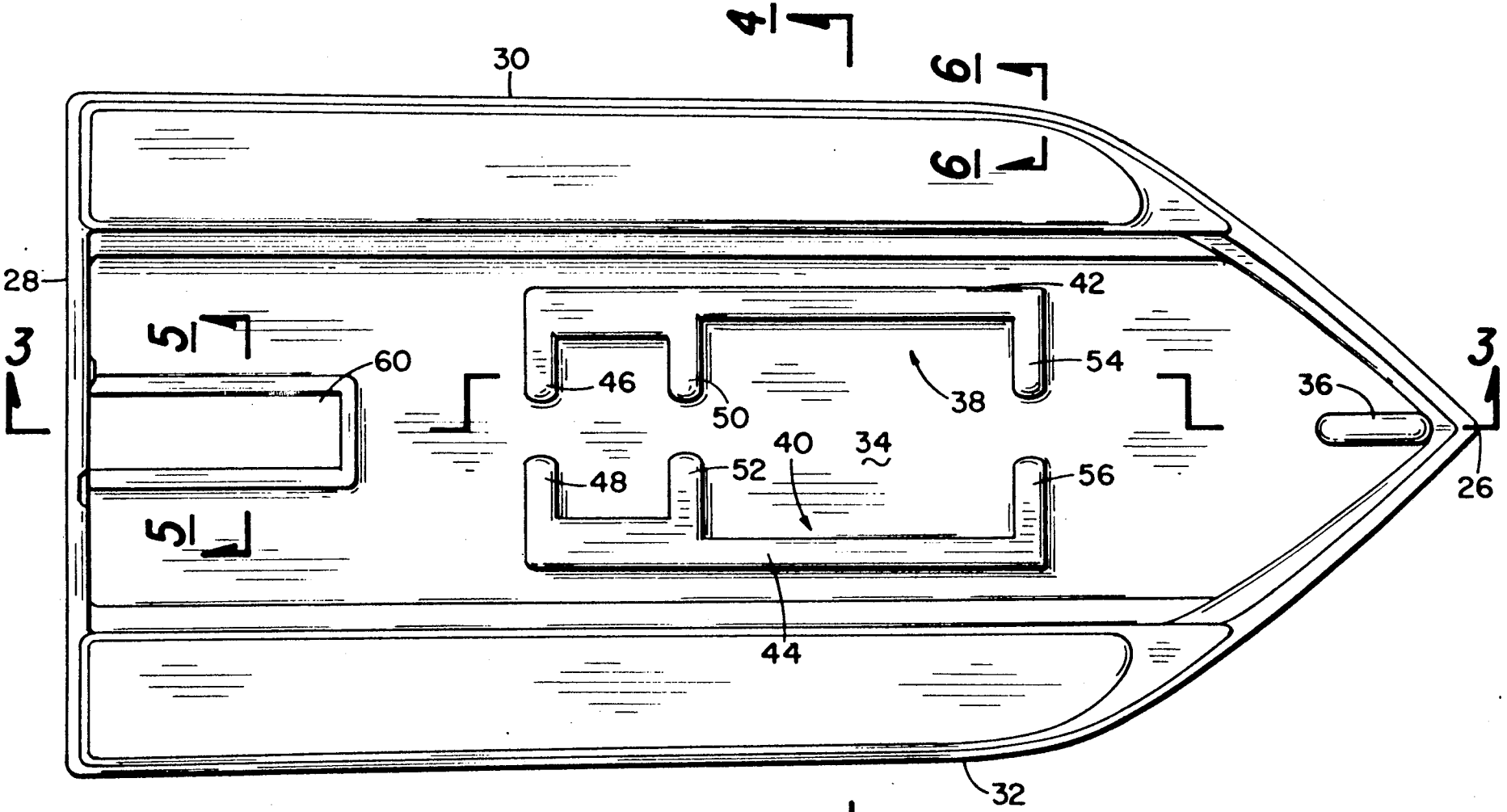
FIG. 2 is a top plan view of the bottom hull with the top of the jet type boat removed.

Referring now to FIG. 2, it is a top plan view of the bottom hull construction of this invention with the top hull removed. The bottom hull encompasses the dimensions of the watercraft from the stem 26 to the stern 28 and port beam 30 and starboard beam 32. The hull 14 of this invention comprises an outer hull and an inner hull. The inner hull comprises a central portion 34 extending from the stem 26 to the stern or transom 28. In this embodiment the inner hull comprises a plurality of strengthening or stiffening areas wherein wood, stringers, plates, or other like reinforcement means are embedded within the inner hull during the molding process. Such areas include the stem 36 (See FIG. 3) which will provide a means for the attachment of a bow eye or similar fixture. In the interior of the hull will be additional longitudinal and transverse stiffeners generally designated by the numeral 38 on the port side and 40 on the starboard side. In this embodiment the stiffeners, which are preformed and embedded within the fiberglass resin construction during the inner liner molding process, comprise respective longitudinal members 42 and 44 and a plurality of transverse stiffening sections 46 and 48, 50 and 52, and 54 and 56. In addition to providing stiffening and rigidity to the hull itself, these also provide a means for mounting and/or supporting the propulsion equipment, hardware, control equipment, batteries, etc. In the aft section of the craft an opening 60 will be formed within the bottom of the hull to provide access for the jet propulsion system. The inner and the outer hull of this invention are formed by the open mold fiber reinforced plastic (FRP) process as will be hereinafter described in greater particularity.

Figure 3:
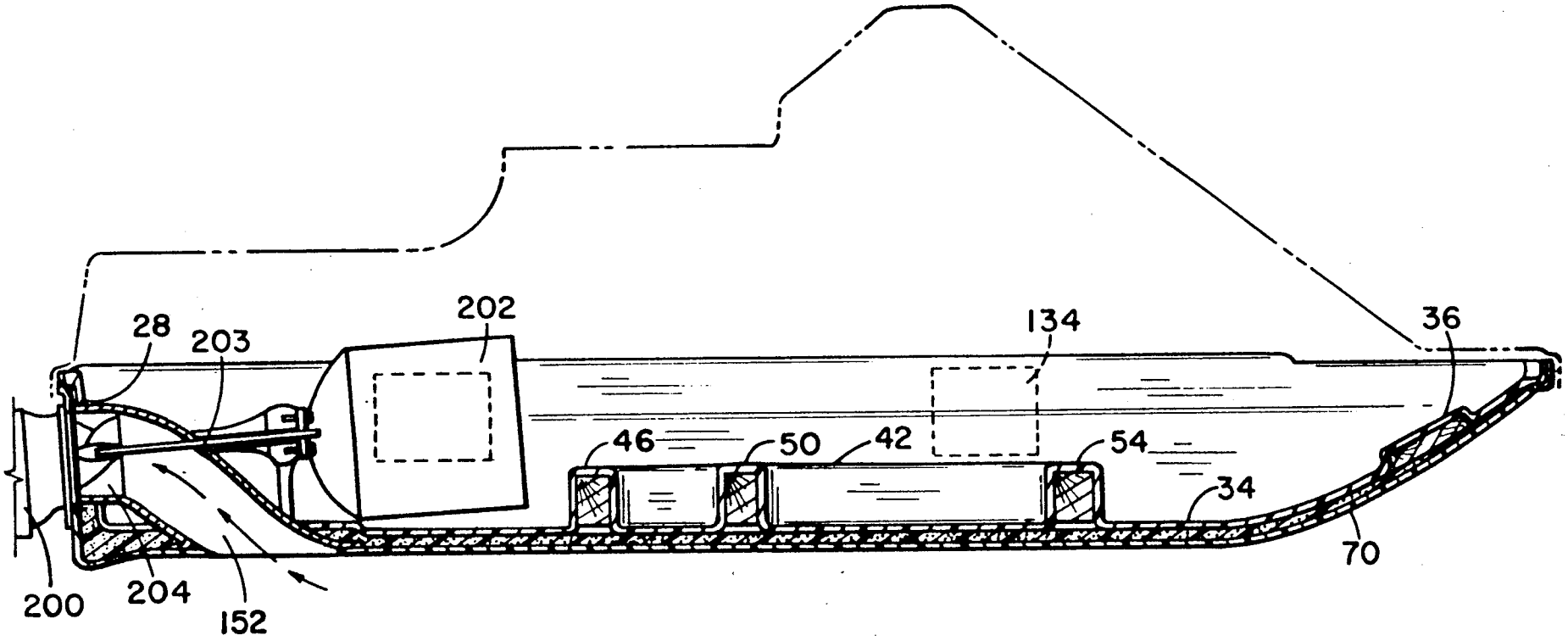
FIG. 3 is a sectional stem-to-stern view of the bottom hull of this invention taken along the line 3—3 of FIG. 2 with the top of the jet type boat being shown in phantom.
Figure 4:
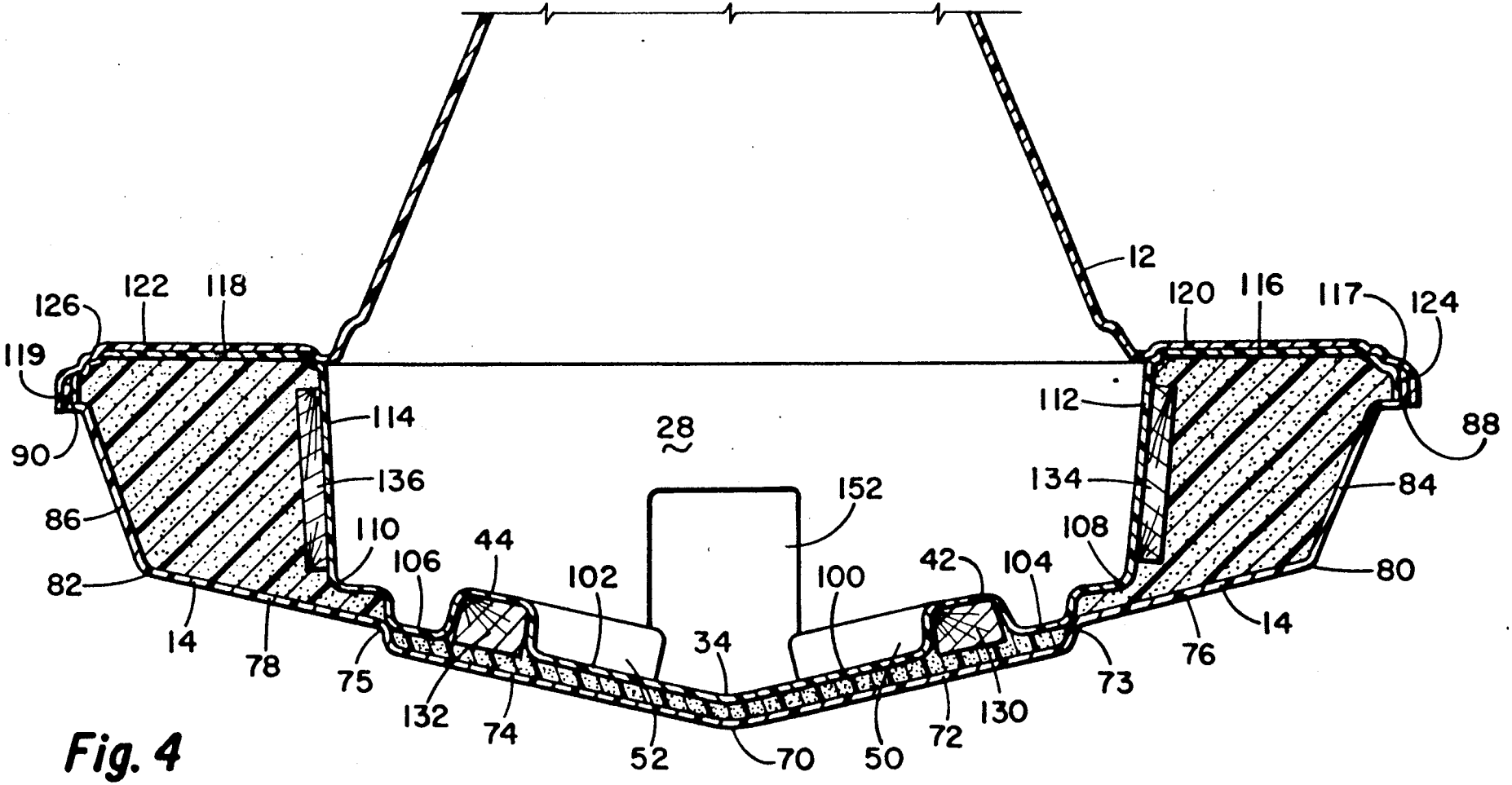
FIG. 4 is a transverse sectional view taken along the beam line 4—4 of FIG. 2 of the hull.
Figure 5:
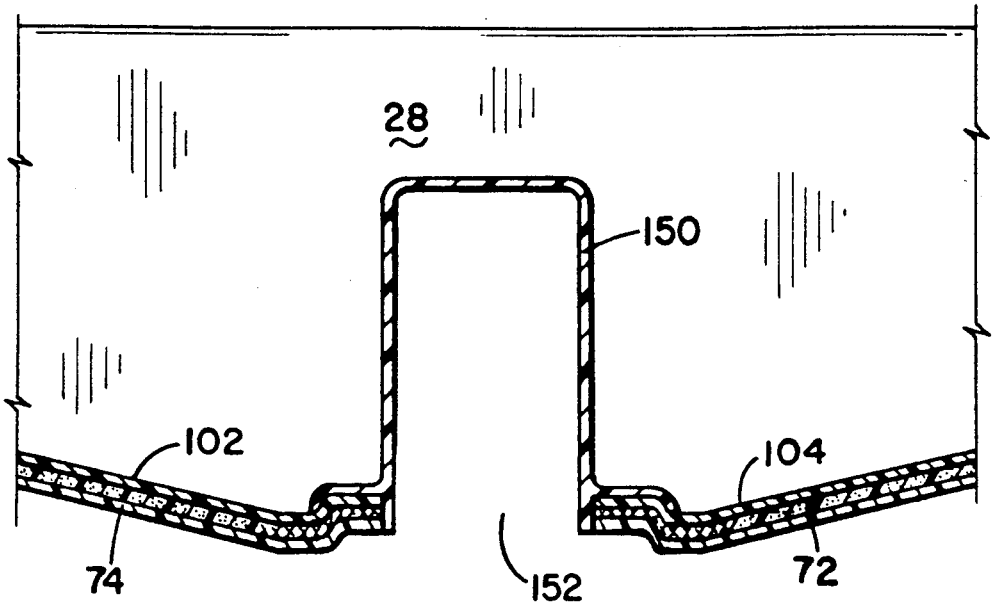
FIG. 5 is a transverse sectional view taken along the beam line 5—5 of FIG. 2.

Referring particularly now to FIGS. 3, 4, and 5, the bottom hull construction forming the essence of this invention is described. Basically, the construction comprises a specially formed outer hull or liner 14 and the inner hull or liner 34 which are separately premolded in open molds with gel-coated exposed surfaces upon which fiber reinforced plastic has been laid. The bottom surface of the outer bottom hull 14 is of a generally Vee-shaped crosssection having a central keel 70 extending outwardly therefrom forming the central planing portions 72 and 74. The central planing portions terminate at upwardly and outwardly stepped portions respectively 76 and 78 which then intersect at respective exterior chines 80 and 82 with upwardly and outwardly directed sides 84 and 86 which then terminate at the upper ends thereof with an outward, then an upward lip 88 and 90.

Figure 6:
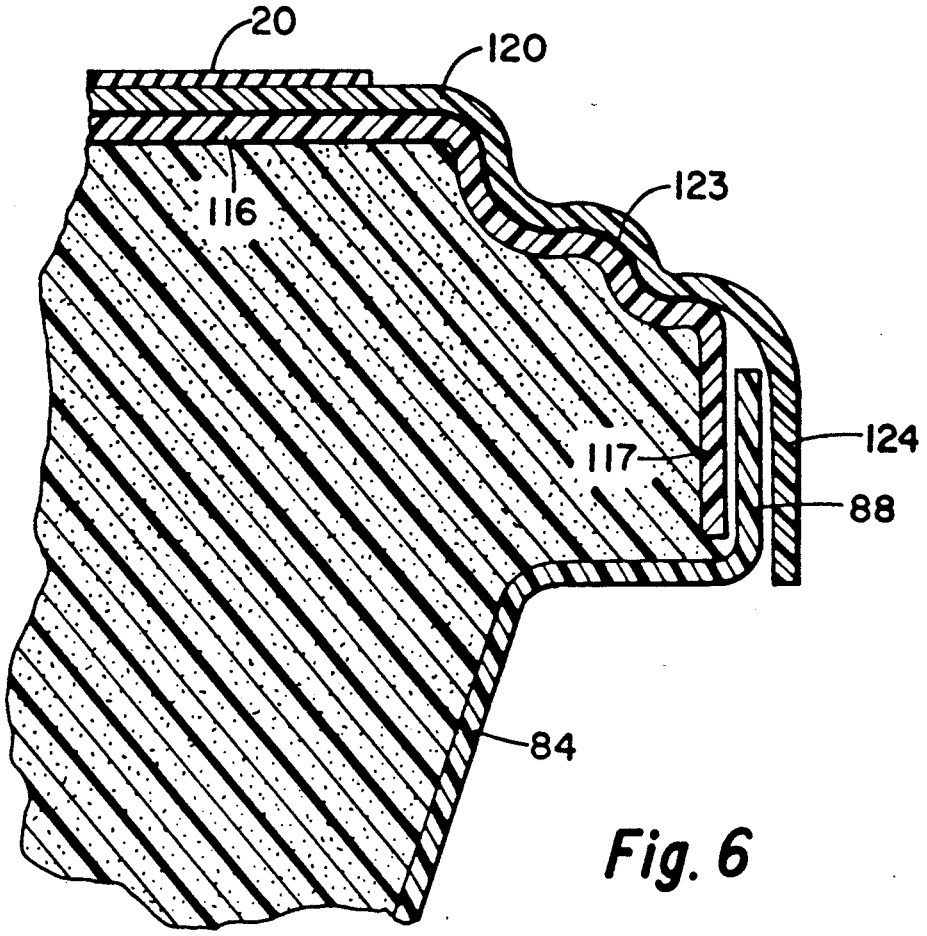
FIG. 6 is a partial sectional view taken along the line 6—6 of FIG. 2 depicting the interconnection of the gunwale-treadway and rub-rail.

The inner liner which is separately premolded by the FRP process has in transverse cross-section a generally Vee-shaped inner central portion 100 and 102 generally matching the configuration of the exterior hull forms 72 and 74. These extend outwardly to first downward steps 104 and 106 which extend interiorly of the outer steps 73 and 75, then with upward interior sides 112 and 114 and thence outward on each side, forming the gunwale and treadway support 116 and 118 upon which the top sides 120 and 122 of the watercraft top will be supported and bonded. The interior portion continues outwardly to downwardly extending lips 117 and 119. The lips 117 and 119 are adapted to be nested and supported inside the upwardly support lips 88 and 90 of the outer liner. The outer edges of the top 12 extend from the gunwale or treadway outwardly and downwardly, forming lips 124 and 126 which extend outside of the upward support lips 88 and 90 of the outer liner. This is best shown in FIG. 6.

An important feature of the invention is in the process of manufacturing the inner liner 34 to include a gel-coated smooth interior side and a plurality of wood reinforcement stringers and plates which are premolded therewith. As shown in FIG. 2, the wood stringers are positioned at significant places such as, referring to FIG. 4, 130 and stringer 42, and 132 and stringer support 44. Also one or a plurality of wood plates 134 and 136 are positioned along the side of the respective vertical portions 112 and 114. These stringers and plates are positioned at significant places to provide stiffness and also means to attach fittings, the propulsion equipment, controls and accessories, because the fiberglass resin plastic is incapable of supporting such equipment satisfactorily.

FIG. 5 is a sectional view to depict the structural features of the propulsion support housing 150 described. An opening 152 is provided in the center of the bottom hull at the junction of Vee portions 72 and 74 and also up the transom. The propulsion unit and its support frame 150 is structurally supported, as hereinafter described, and retained to the interior hull and to the transom 28.

Referring to FIG. 3, the propulsion system shown schematically is attached to the housing. The propulsion system includes a gasoline engine 202 mounted to the hull at 203 which drives, via shaft 203, a high pressure pump impeller 204 in the aft section. A well or opening 152 formed in the bottom of the hull scoops water, directing it into the impeller blades 204 where it is discharged to outlet nozzle 200 being thereby converted to a coherent high pressure jet designed to propel the craft through and across the water. The craft is steered by pivoting the jet nozzle 200 in a horizontal arc about a vertical axis using cables or lever arms (not shown).

It has been found that the combination of the bottom hull design as described herein and the placement of the propulsion system are such that the craft is substantially level when at rest and will, when accelerated, achieve a substantially immediate planing mode wherein only the aft two to three feet of the bottom hull are in skimming contact with the water, and without the excessive bounce and pounding action normally associated with jet type hulls of the prior art.

Figure 7:
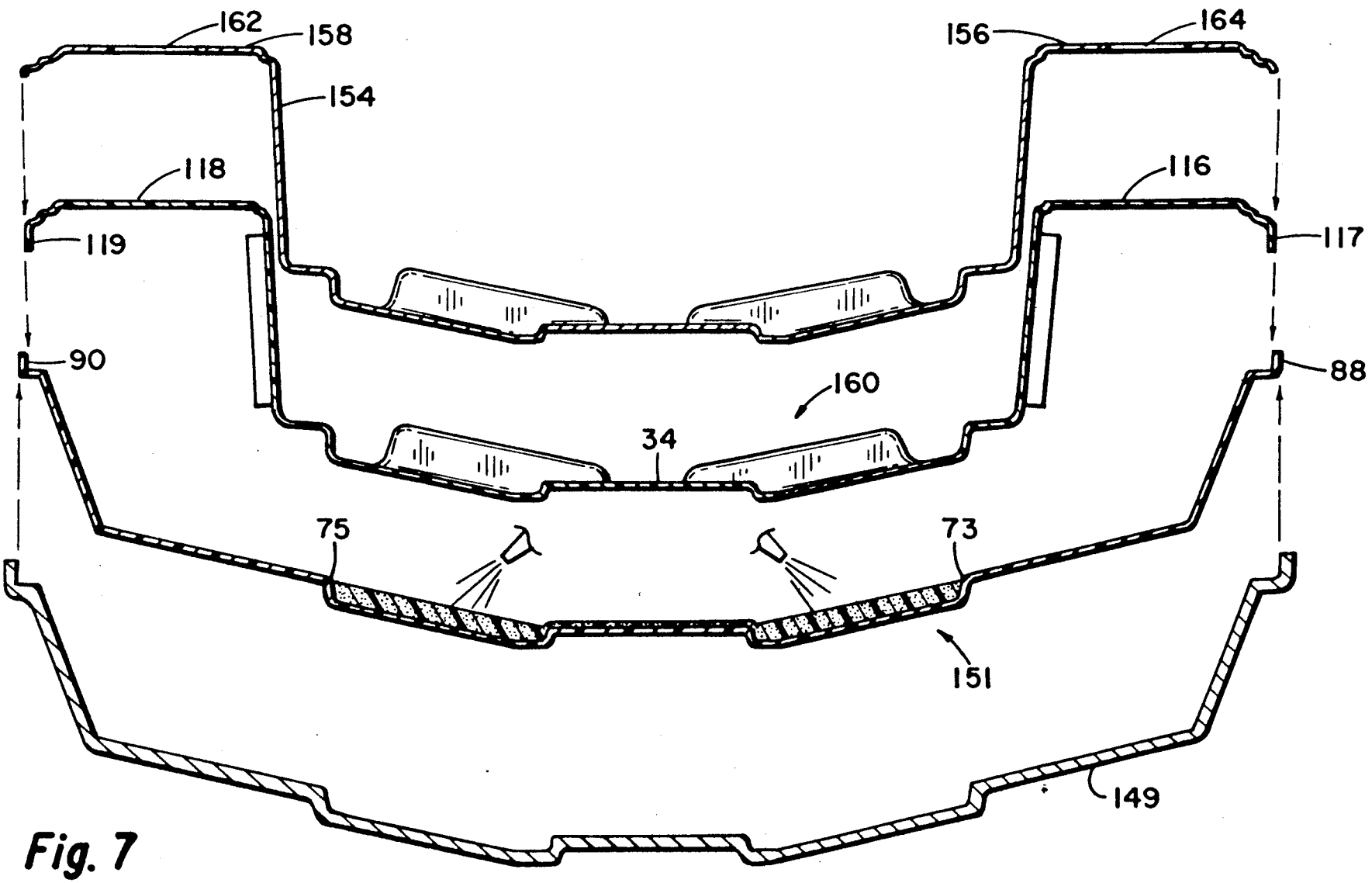
FIG. 7 is a sectional schematic depicting the basic concepts in the process of making the bottom hull of this invention.

The schematic of FIG. 7 represents the process for forming the hull of this invention. The outer liner generally designated by the numeral 151 is formed in an open mold 149 by a fiber reinforced plastic (FRP) process as heretofore described, utilizing a gel-coat/catalyst mixture being applied to the interior of the mold 149 to a thickness of about 15 to 20 mil. This is followed by the application of fiberglass reinforcement in the form of woven roving, mat, or gun roving plus polyester resin and catalyst. Once set up, the outer liner 1511 will be an exact duplicate of the mold 149 and, although shown separated from the mold in FIG. 7, the outer liner 151 will be retained within the open mold form 149. In a separate open mold 154, turned upside down in this view, the inner liner, generally designated by the numeral 160, will be formed containing, as has herein been previously described, the necessary wood stringers and supports as will be necessary during the later assembly of the jet type watercraft and its peripheral equipment.

Once both outer and inner hull forms have been set up, the next step in the process is to spray or pour polyurethane foam forming material into the lower hull between the upward stepped portion of the hull 73 and 75 which may be sprayed or brushed. Before this material is permitted to set up, the inner hull is next placed over the outer hull to nest therein, wherein the outer and downward lips 117 and 119 nest inside the upward lips 88 and 90 of the outer hull. Appropriate fiberglass resin, with or without the fibers, may be applied to the exterior lip surfaces to aid in the bonding of the two halves together. To aid in the molding process and keep the inner liner and the outer liner from deforming during the assembly and initial foam forming process, a negative mold 154, which in all respects is substantially similar to the open mold which formed the inner liner 34 except that the downward lips 117 and 119 are omitted. This negative mold, because of its weight and shape, etc., is then positioned upon the interior mold with the entire assembly being retained together by sandwiching the exterior and the interior molds between the two mold forms 149 and 154. The mold form 154 includes, along the horizontal sides 156 and 158, a plurality of openings, only one being shown in each side respectively 162 and 164. Once the manufacturer is secure that the interior and exterior hull forms are mated and joined together, openings are drilled through the gunwale 116 and 118 providing communication with the flotation space formed therebelow. Subsequently, polyurethane foam forming material is injected into this space in sufficient amounts to fill the space therebetween and thus, because of the crosslinking nature of the chemicals, provide additional bonding of the two liners at an additional rigidity and flotation to the hull.

Figure 10:
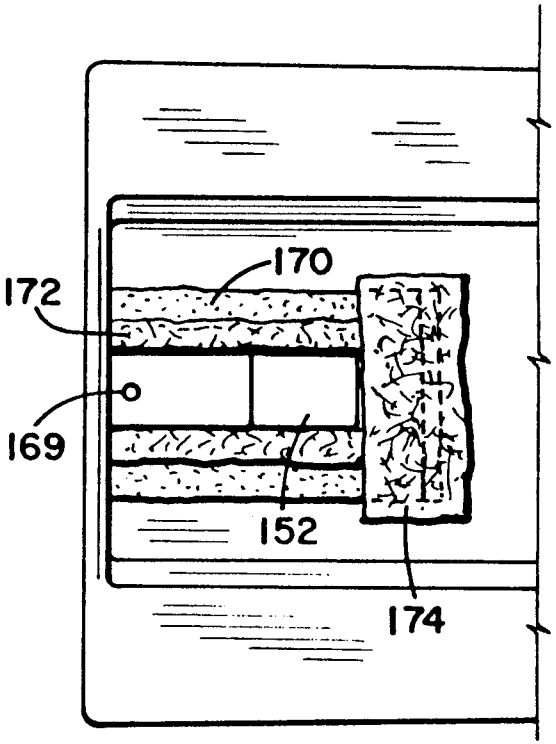
FIGS. 8, 9, and 10 are partial top views depicting a method of lay-up of reinforcement fibers and resin where the propulsion housing will attach to the hull.
Figure 9:
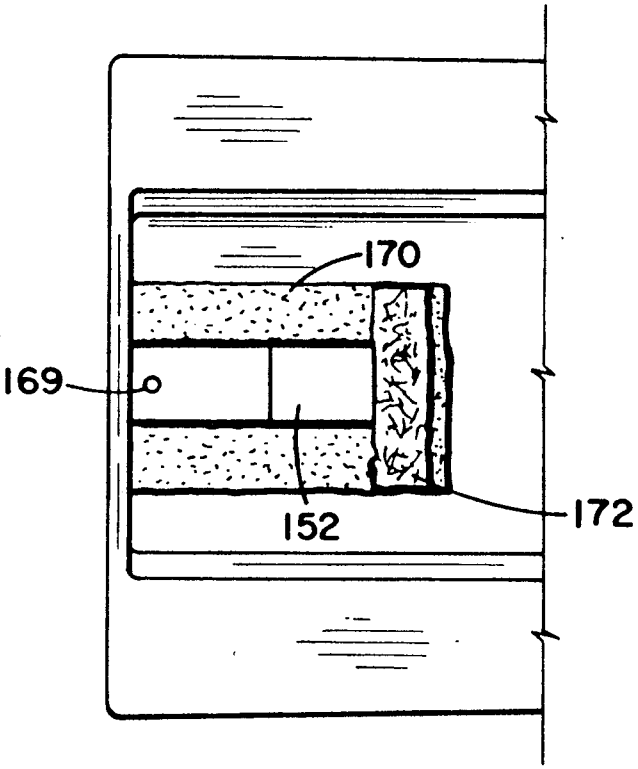
Figure 8:
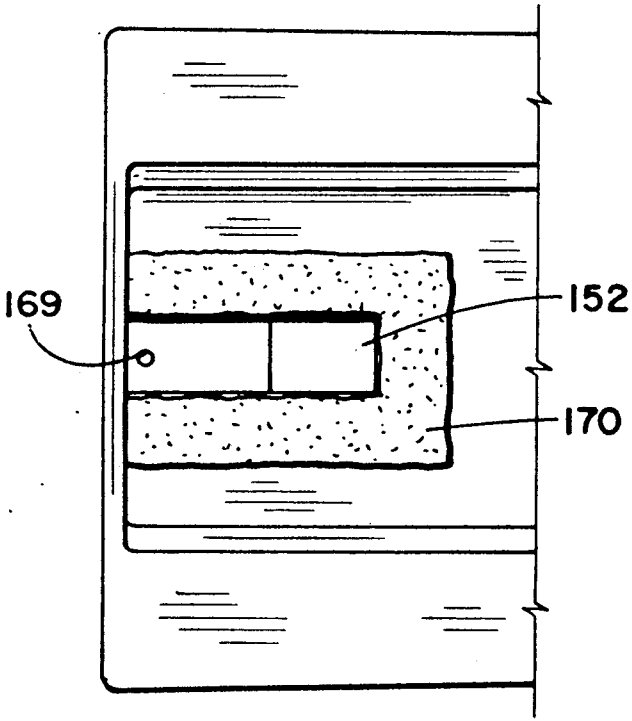

Referring now to FIGS. 8, 9, and 10 and before the interior hull 34 is nested within the outer or exterior hull, reinforcing material is provided around the jet propulsion opening 152 adjacent the transom. In these views the entire opening has not been cut to allow a clamp to be inserted after the inner hull has been nested to assist in retaining the hulls together until bonded and set. Bolt hole 169 is formed in the remaining pad of resin and glass as a further means to retain the inner and outer hulls together during the assembly process.

As shown in FIG. 8, and during the formation of the outer hull, while the reinforcing comprises a resin wet under-layer of fiberglass chop or mat around the opening followed by a first V-shaped piece 170 of fiberglass reinforced composite mat or cloth such as sold under the mark TIGERCORE or other high modulus of elasticity reinforcement material such as S-GLASS or R-GLASS. Additional woven roving and resin, not shown, can be applied on top of layers 169 and allowed to set-up and dry. As shown in FIG. 9, an additional layer of TIGERCORE 172 is applied along the bight followed by another layer of fiberglass mat or chop and resin 174 (see FIG. 10). Next a bead or urethane caulk, such as sold by the 3M Company as their No. 5200 sealant, is placed around the opening upon which the inner hull portions will rest, be clamped and bonded. Subsequently, the propulsion support housing will be bonded to the inner hull as shown in FIG. 5.

Figure 11:
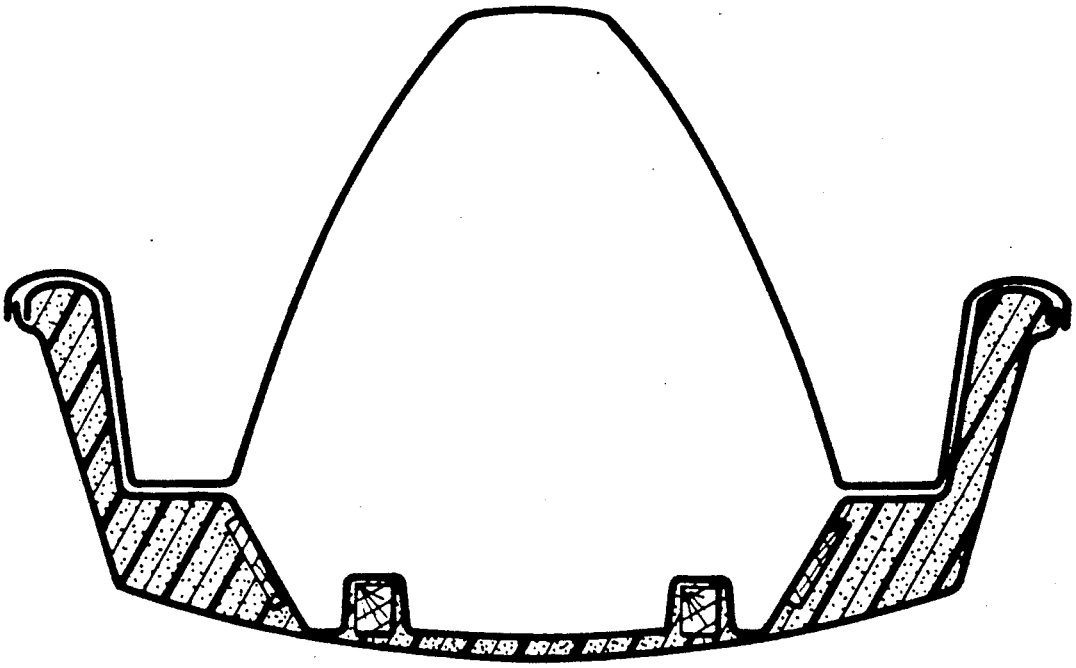
FIG. 11 depicts another type of jet type boat hull design to which the method of manufacture according to this invention is applicable.

FIG. 11 depicts an additional style of jet type hull, in cross-section, to which the concepts of this invention is applicable.

We claim:

1. In jet type watercraft having a hull, said hull having a top portion and a bottom portion, the improvement in said bottom portion comprising;

an outer liner and an inner liner spaced therefrom, both liners being pre-molded of gel-coated exposed surface fiber reinforced plastic, said outer liner having in transverse cross-section, a generally Vee-shaped outward portion intersecting at exterior chines with upwardly and outwardly directed sides and outward then upward lips, said inner liner in said transverse cross-section being generally Vee-shaped in its central portion intersecting at interior chines with upward sides thence extending substantially horizontally outward to downwardly extending lips positioned inside said upward lips, said inner liner having reinforcing wood stringers premolded therewith as a means to attach propulsion equipment and accessories thereto, said inner liner being spaced from said outer liner, said space being filled with polyurethane foam.

2. A method of making a bottom hull including stem, sides, and transom for a jet type watercraft comprising the steps of:

forming, in a first open mold, an outer liner comprised of a gel-coat exterior and a fiber reinforced plastic interior, said outer liner being in transverse cross-section of a generally Vee-shape defined by a central portion and upwardly stepped outer portions on each side of said central portion intersecting at exterior chines with upwardly and outwardly directed sides and outward then upward lips;

leaving said outer liner in said first open mold;

forming in a second open mold an inner liner comprised of a gel-coated interior and fiber reinforced plastic, said inner liner, in transverse cross-section, having a generally Vee-shaped central portion that is substantially parallel to said central portion of said outer liner with upward interior sides, thence extending essentially horizontally outward forming a gunwale to downwardly extending lips, said inner liner including reinforcing and other means to support propulsion equipment for said watercraft;

applying a polyurethane foam forming material to said interior central portion of said outer liner;

removing said inner liner from said second open mold;

positioning said inner liner into the interior of said outer liner whereby said central portions are aligned and said downwardly extending lips of said inner liner nest inside said upwardly extending lips of said outer liner and whereby a longitudinal space is formed on each side between said upward interior sides and said gunwale of said inner liner and said upwardly directed sides of said outer liner;

positioning a press mold of shape substantially equal to said interior configuration of said inner into the inner liner to apply pressure to said inner liner and outer liner; and injecting into said longitudinal side space polyurethane foam forming materials.

3. A jet type watercraft having a hull, said hull having a top portion and a bottom portion, said bottom portion comprising:

an outer hull and a nested inner hull spaced therefrom, the contour of the outer hull having, in transverse cross-section, a keel, a central portion extending on each side of said keel to a left and a right upward step thence outward to a port chine and a starboard chine thence upwardly forming sides of said hull to a rub-rail;

the contour of said inner hull having, in said transverse cross-section, a central portion generally parallel to said contour of said central portion of said outer hull to a left and a right upward step which abuts with said respective left and right upward steps of said outer hull to thereby create a substantially sealed space between said outer hull and said inner hull, said sealed space being filled with a polyurethane foam, said contour of said inner hull continuing with upward port and starboard interior sides to a substantially horizontal gunwale thence outward to sealed engagement with said rub-rail, said interior sides being spaced from said respective port and starboard sides of said outer hull forming respective port and starboard flotation chambers.

4. The craft of claim 3 wherein said flotation chambers are polyurethane foam filled.

5. The craft of claim 3 wherein said rub-rail is comprised of an upward lip in said outer hull, a downward lip in said inner hull which nests inside said upward lip of said outer hull.

6. The craft of claim 3 wherein inner and outer exposed surfaces of said outer hull and said inner hull are smooth.

7. The craft of claim 3 wherein said outer hull and said inner hull are formed of FRP, with smooth gel-coated interior and exterior exposed surfaces.

8. The craft of claim 7 wherein said inner hull includes on an unexposed side of said central portion, longitudinal and transverse reinforcing wood stringers premolded therewith, and at least one wood plate in said port and said starboard sides thereof.

9. The craft of claim 8 including a bottom opening adjacent a transom, a housing covering said opening and bonded to said inner hull, and means to attach a jet propulsion system to said housing.

10. The craft of claim 3 wherein said top portion of said hull rests upon and is bonded to said gunwale of said inner hull and further including an outer downward lip that forms the outside portion of said rub-rail.

* * * * *